US005450992A

United States Patent [19]

Coffee

[11] Patent Number: 5,450,992

[45] Date of Patent: Sep. 19, 1995

[54] DART CARRIER

[76] Inventor: Jerry L. Coffee, 520 E. De La Guerra #B, Santa Barbara, Calif. 93103

[21] Appl. No.: 259,065

[22] Filed: Jun. 13, 1994

[51] Int. Cl.[6] ..... B65D 85/00

[52] U.S. Cl. ..... 224/240; 224/252; 224/224; 206/315.1

[58] Field of Search ..... 224/252, 901, 916, 918, 224/920, 224, 225, 227, 240, 241, 242; 206/315.1, 370, 373

[56] References Cited

U.S. PATENT DOCUMENTS

| | | | |
|---|---|---|---|
| 2,850,220 | 9/1958 | Ehrler et al. | 224/920 |
| 3,490,169 | 1/1970 | Tweed | 206/315.1 |
| 4,255,872 | 3/1981 | Williams, Jr. | 206/373 |
| 4,294,348 | 10/1981 | Hastings | 206/373 |
| 4,703,852 | 11/1987 | Veadier | 206/373 |
| 4,765,470 | 8/1988 | Curci | 224/252 |
| 4,773,578 | 9/1988 | Braun | 206/315.1 |
| 4,911,296 | 3/1990 | Hart, Jr. | 206/373 |
| 5,067,610 | 11/1991 | Jensen | 206/315.1 |
| 5,114,007 | 5/1992 | Chen | 206/373 |
| 5,148,914 | 9/1992 | Budert et al. | 206/379 |
| 5,165,537 | 11/1992 | Neff et al. | 206/315.1 |
| 5,238,108 | 8/1993 | Velezis et al. | 206/315.1 |

*Primary Examiner*—Henry J. Recla
*Assistant Examiner*—Gregory M. Vidovich

[57] ABSTRACT

A dart carrier for holding and transporting darts and accessories comprising a base further comprising a hollow interior bounded by a backing with a sidewall peripherally extended from the backing; a plurality of compartments formed within the interior; a drawer slidably disposed in one of the compartments with each drawer adapted for holding dart accessories; a plurality of pockets disposed in several compartments with each pocket adapted for holding dart accessories therein; and a dart holder disposed in a compartment with the dart holder adapted for holding darts; a cover further comprising a hollow interior bounded by a backing with a sidewall peripherally extended from the backing; a plurality of compartments formed within the interior; a plurality of pockets disposed in several compartments with each pocket adapted for holding dart accessories; and a tip holder disposed in a compartment with the tip holder adapted for holding dart tips; and hinge for pivotally coupling the cover to the base.

2 Claims, 3 Drawing Sheets

FIG. 3
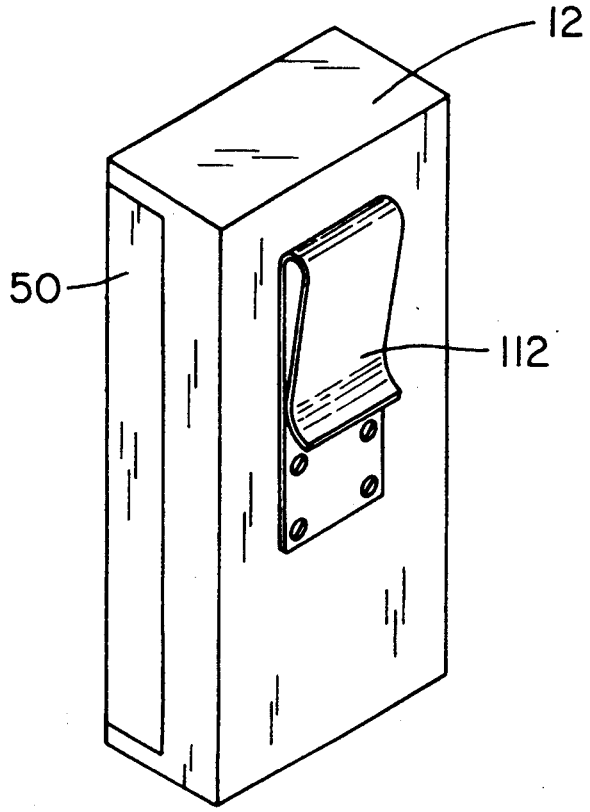
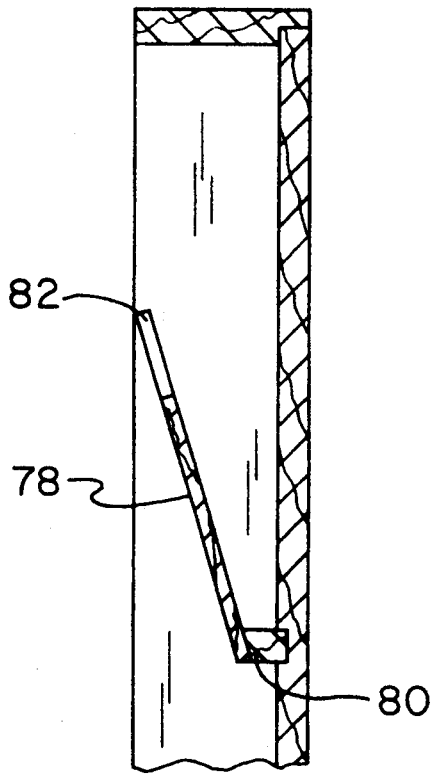
FIG. 4

DART CARRIER

BACKGROUND OF THE INVENTION

1. Field of the Invention

The present invention relates to a dart carrier and more particularly pertains to holding and transporting darts and accessories with a dart carrier.

2. Description of the Prior Art

The use of dart carrying cases is known in the prior art. More specifically, dart carrying cases heretofore devised and utilized for the purpose of holding darts are known to consist basically of familiar, expected and obvious structural configurations, notwithstanding the myriad of designs encompassed by the crowded prior art which have been developed for the fulfillment of countless objectives and requirements.

By way of example, U.S. Pat. No. 308,783 to Pearson disposes a combined dart and dart tip holder. U.S. Pat. No. 309,924 to LeFebvre, Jr. disposes a holder for dart parts. U.S. Pat. No. 4,773,578 to Braun disposes a dart carrying case. U.S. Pat. No. 5,127,210 to Jensen disposes a dart storage and transport apparatus and method. U.S. Pat. No. 5,165,537 to Neff et al. disposes a display and carrying case for darts. U.S. Pat. No. 5,238,108 to Velezis et al. disposes a dart case.

While these devices fulfill their respective, particular objective and requirements, the aforementioned patents do not describe a dart carrier that holds darts, dart tips, and associated accessories in a configuration adapted to be conveniently carried and easily transported by a user.

In this respect, the dart carrier according to the present invention substantially departs from the conventional concepts and designs of the prior art, and in doing so provides an apparatus primarily developed for the purpose of holding and transporting darts and accessories.

Therefore, it can be appreciated that there exists a continuing need for new and improved dart carrier which can be used for holding and transporting darts and accessories. In this regard, the present invention substantially fulfills this need.

SUMMARY OF THE INVENTION

In the view of the foregoing disadvantages inherent in the known types of dart carrying cases now present in the prior art, the present invention provides an improved dart carrier. As such, the general purpose of the present invention, which will be described subsequently in greater detail, is to provide a new and improved dart carrier and method which has all the advantages of the prior art and none of the disadvantages.

To attain this, the present invention essentially comprises a base. The base includes a hollow interior bounded by an essentially rectangular backing plate having an inner surface and an outer surface, opposed inner and outer side walls, and opposed top and bottom walls with the top and bottom walls having a length greater than the side walls. The base includes a first wall disposed within the interior and extended between the inner and outer side walls to define a first compartment located between the first wall and the bottom wall. The base includes a second wall extended between the top wall and first wall to define a second compartment located adjacent to the inner side wall and a third compartment located adjacent to the outer side wall. The base includes a drawer slidably disposed within the first compartment and adapted for holding dart accessories therein. The base includes a plurality of angular pockets disposed within the second compartment with each adapted for holding dart accessories therein. Lastly, the base includes a block-shaped dart holder disposed upon the first wall in the third compartment with the dart holder having a plurality of recesses formed therein with each recess adapted to hold a dart in an upright position. The dart holder pivots on a hidden pin to allow easy access to the darts.

The present invention has a cover. The cover includes a hollow interior bounded by an essentially rectangular backing plate having an inner surface and an outer surface, opposed inner and outer side walls, and opposed top and bottom walls. The cover includes a first wall disposed within the interior and extended between the top and bottom walls to define a first compartment located adjacent to the outer side wall. The cover includes a second wall disposed within the interior and extended between the inner side wall and first wall to define a second compartment located above the second wall and a third compartment located below the second wall. The cover includes a plurality angular pockets disposed within the first compartment with each adapted for holding dart accessories therein. The cover includes a plurality of angular pockets disposed within the second compartment with each adapted for holding dart accessories therein. The cover includes a block-shaped tip holder slidably disposed in the third compartment between the rails and bottom wall with the tip holder having plurality of recesses formed therein with each recess adapted to hold a tip of a dart in an upright position. The tip holder pivots on a hidden pin to allow easy access to dart tips. The cover includes a first groove formed along the inner side wall at a location offset from the backing plate and a second groove formed along the first wall at a location offset from the backing plate such that the first groove and the second groove are planarly aligned. Lastly, the cover includes a rectangular door slidably disposed within the first and second grooves.

Hinge means are hidden pins connected to the top and bottom plates, joining the same to the inner side wall of the cover. Fastening means are included for securing the cover to the base and thereby preventing access to the interiors of the cover and base. Lastly, a clip is included and coupled to the outer surface of the backing plate of the base with the clip having a loop formed thereon adapted to be secured to the belt or clothing of a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart carrier which has all the advantages of the prior art dart carrying cases and none of the disadvantages.

It is another object of the present invention to provide a new and improved dart carrier which may be easily and efficiently manufactured and marketed.

It is a further object of the present invention to provide a new and improved dart carrier which is of durable and reliable construction.

An even further object of the present invention is to provide a new and improved dart carrier which is susceptible of a low cost of manufacture with regard to both materials and labor, and which accordingly is then susceptible of low prices of sale to the consuming public, thereby making such a dart carrier economically available to the buying public.

Still yet another object of the present invention is to provide a new and improved dart carrier which provides in the apparatuses and methods of the prior art some of the advantages thereof, while simultaneously overcoming some of the disadvantages normally associated therewith.

Even still another object of the present invention is to provide a new and improved dart carrier for holding and transporting darts and accessories.

Lastly, it is an object of the present invention to provide a new and improved dart carrier comprising a base further comprising a hollow interior bounded by a backing with a sidewall peripherally extended from the backing; a plurality of compartments formed within the interior adapted for holding dart accessories therein; a plurality of pockets disposed in several compartments with each pocket adapted for holding dart accessories therein; and a dart holder disposed in a compartment with the dart holder adapted for holding darts; a cover further comprising a hollow interior bounded by a backing with a sidewall peripherally extended from the backing; a plurality of compartments formed within the interior; a plurality of pockets disposed in several compartments with each pocket adapted for holding dart accessories therein; and a tip holder disposed in a compartment with the tip holder adapted for holding dart tips; and hinge means for pivotally coupling the cover to the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the present invention depicting the coupling between the clip and base.

FIG. 4 is a cross-sectional view of the cover of the present invention taken along the line 4—4 of FIG. 2.

The same reference numerals refer to the same parts through the various Figures.

DESCRIPTION OF THE PREFERRED EMBODIMENT

Figure 2:
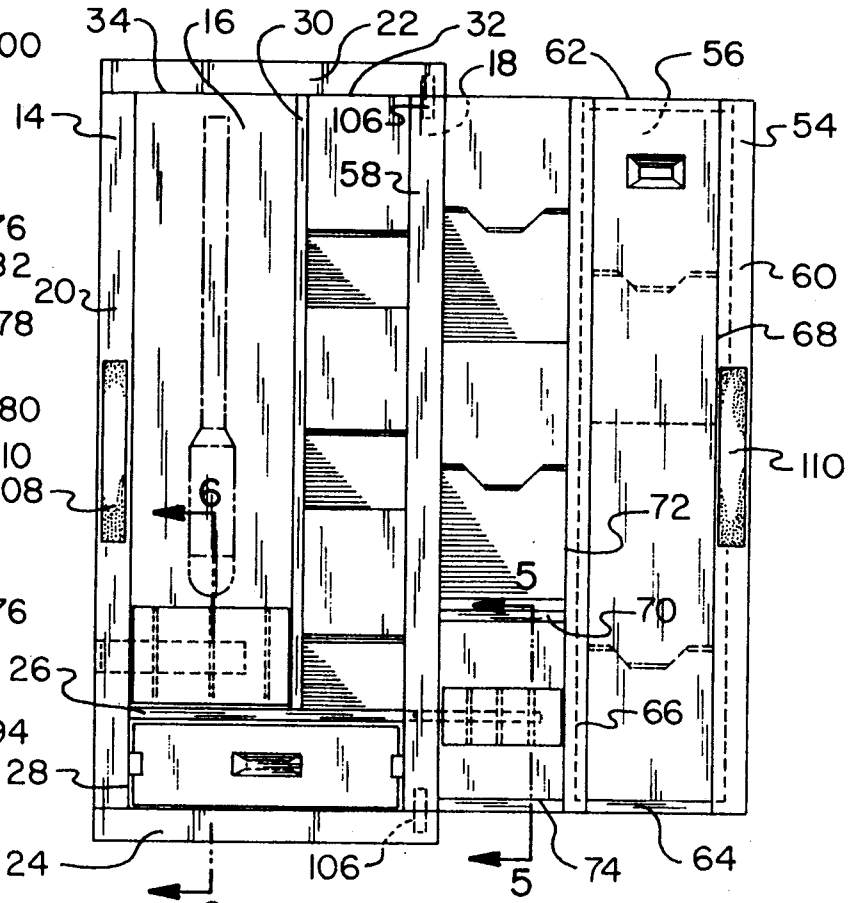
FIG. 2 is a side elevational view of the present invention with its sliding door in a closed orientation.
Figure 1:
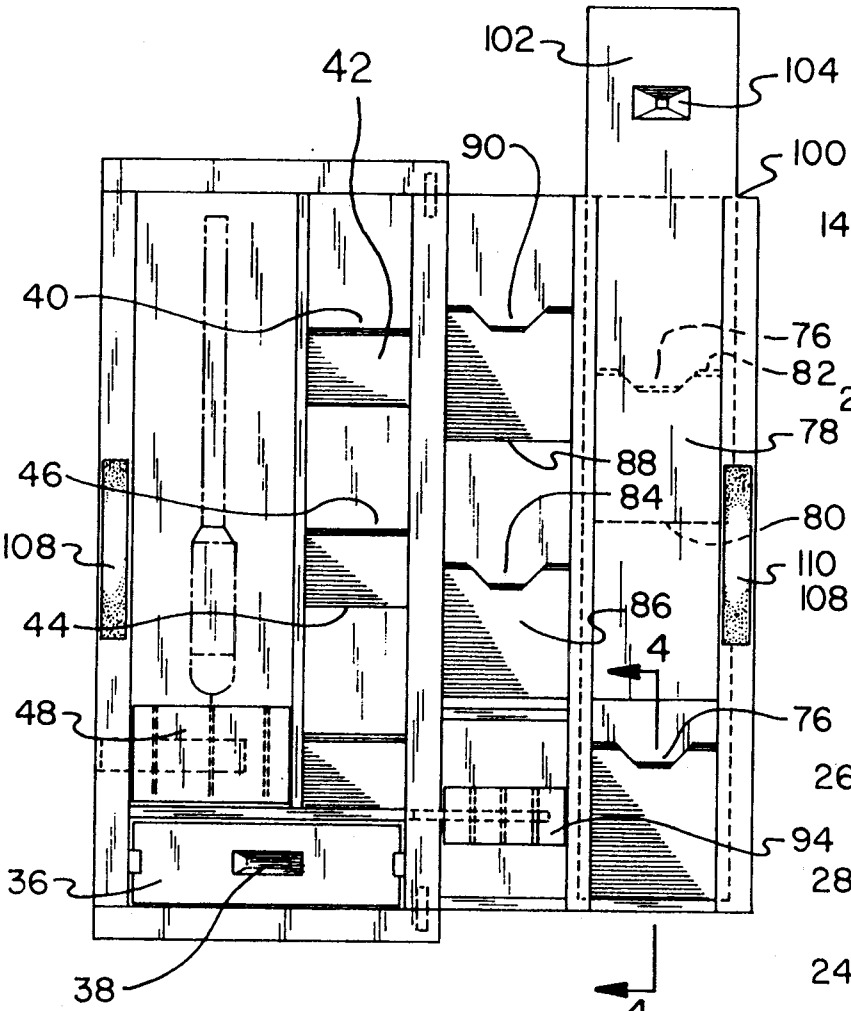
FIG. 1 is a side elevational view of the preferred embodiment of the dart carrier constructed in accordance with the principles of the present invention with its sliding door in an opened orientation.
Figure 6:
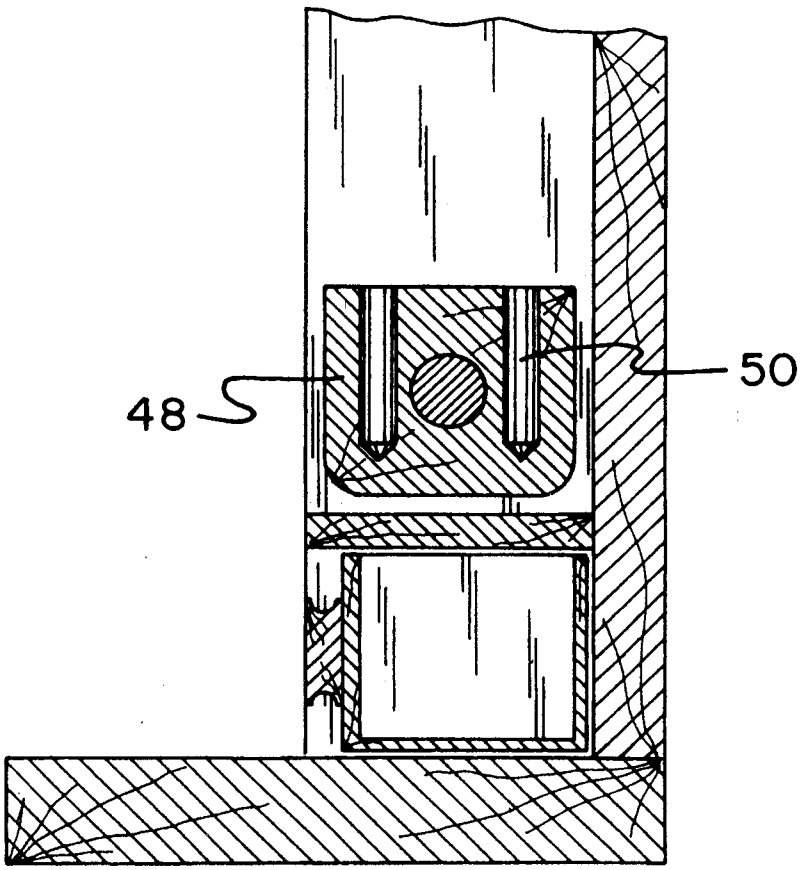
FIG. 6 is a cross-sectional view of the base of the present invention taken along the line 6—6 of FIG. 2.
Figure 5:
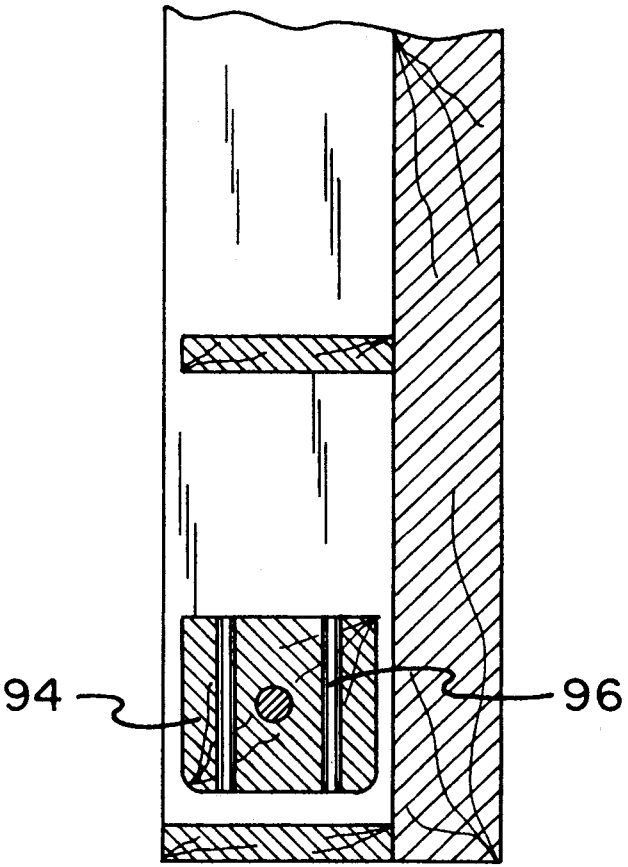
FIG. 5 is a cross-sectional view of the cover of the present invention taken along the line 5—5 of FIG. 2.

With reference now to the drawings, and in particular, to FIG. 1 thereof, the preferred embodiment of the new and improved dart carrier embodying the principles and concepts of the present invention and generally designated by the reference number 10 will be described.

Specifically, the present invention includes six major components. The major components are the base, cover, hinge means, pin, and loop fastener. These components are interrelated to provide the intended function.

More specifically, it will be noted in the various Figures that the first major component is the base 12. The base includes six subcomponents. The subcomponents are the peripheral portion, first wall, second wall, drawer, pockets, and dart holder. The subcomponents are interrelated to provide the intended function.

The first subcomponent of the base is the peripheral portion 14. The peripheral portion includes a hollow interior. The hollow interior is bounded by an essentially rectangular backing plate 16 having an inner surface and an outer surface, opposed inner and outer side walls 18, 20 and opposed top and bottom walls 22, 24. The top and bottom walls have a length less than the side walls. The peripheral portion contains the remaining subcomponents therein.

The second subcomponent of the base is the first wall 26. The first wall is disposed within the interior of the peripheral portion 14. It is extended between the inner and outer side walls 18, 20 at a distance offset from the bottom wall 24. The first wall in conjunction with the peripheral portion defines a first compartment 28 located between the first wall and the bottom wall.

The third subcomponent of the base is the second wall 30. The second wall is disposed within the interior of the peripheral portion 14. It is extended between the top wall 22 and the first wall 26 at a location between the inner side wall 18 and the outer side wall 20. The second wall in conjunction with the peripheral portion defines a second compartment 32 located adjacent to the inner side wall. The second wall in conjunction with the peripheral portion also defines a third compartment 34 located adjacent to the outer side wall.

The fourth subcomponent of the base is the drawer 36. The drawer is slidably disposed within the first compartment 28. It is adapted for holding dart accessories therein. The drawer has a recessed handle 38 formed thereon. The handle is used for allowing the drawer to be opened or closed.

The fifth subcomponent of the base is the pockets 40. The pockets are formed of a plurality of spaced and essentially rectangular shelves disposed within the second compartment 32. Each shelve has a bottom edge 44 extended between the second wall and the inner side wall at a location adjacent to the inner surface of the backing plate. Each shelf also has top edge 46 extended between the second wall and inner side wall at a location offset from the inner surface of the backing plate. In this configuration, each shelf in conjunction with the second wall, inner side wall, and backing plate defines a pocket. Each pocket is used for holding dart accessories therein.

The sixth subcomponent of the base is the dart holder 48. The dart holder is blocked-shaped in structure. It is disposed upon the first wall 26 in the third compartment 34. The dart holder has a plurality of recesses 50 formed therein. Each recess is adapted to hold a dart in an upright position.

The second major component is the cover 50. The cover includes eight subcomponents. The subcomponents are the peripheral portion, the first wall, second wall, pockets, tip holder, groves, and door. These subcomponents are interrelated to provide the intended function.

The first subcomponent of the cover is the peripheral portion 54. The peripheral portion has a hollow interior bounded by an essentially rectangular backing plate 56 having an inner surface and an outer surface, opposed inner and outer side walls 58, 60, and opposed top and bottom walls 62, 64. The peripheral portion contains the remaining subcomponents therein.

The second subcomponent of the cover is the first wall 66. The first wall is disposed within the interior and extended between the top and bottom walls 62, 64 at a location between the inner side wall and the outer side wall 58, 60. The first wall in conjunction with the peripheral portion 54 defines a first compartment 68 located adjacent to the outer side wall 60.

The third subcomponent of the cover is the second wall 70. The second wall is disposed within the interior and extended between the inner side wall 58 and first wall 66. The second wall in conjunction with the peripheral portion 54 defines a second compartment 72 located above the second wall and a third compartment 74 located below the second wall.

The fourth subcomponent of the cover is the pocket 76. The pockets are defined by a plurality of spaced and essentially rectangular shelves 78 disposed within the first compartment 68. Each shelf has a bottom edge 80 extended between the first wall 66 and the outer side wall 60 at a location adjacent to the inner surface of the backing plate. Each shelve also includes a notched top edge 82 extended between the first wall and the outer wall at a location offset from the inner surface of the backing plate. In this configuration, each shelf in conjunction with the first wall, outer side wall, and backing plate defines a pocket. Each pocket is used for holding dart accessories therein.

Furthermore, pockets are defined by a plurality of spaced and essentially rectangular shelves 86 disposed within the second compartment. Each shelve has a bottom edge 88 extended between the first wall 66 and the inner side wall 58 at a location adjacent to the inner surface of the backing plate. Each shelf also has a notched top edge 90 extended between the first wall and the inner side wall at a location offset from the inner surface of the backing plate. In this configuration, each shelf in conjunction with the first wall, inner side wall, and backing plate defines a pocket. Each pocket is used for holding dart accessories therein.

The fifth subcomponent of the cover is the tip holder 94. The tip holder is block-shaped. The tip holder has a plurality of recesses 96 formed therein. Each recess is adapted to hold a tip of a dart in an upright position.

The sixth subcomponent of the cover is the grooves 100. The present invention includes a first groove and a second groove. The first groove is formed along the inner side wall 66 at a location offset from the backing plate. The second groove is formed along the first wall 60 at a location offset from the backing plate. In this configuration, the grooves are planarly aligned.

The seventh subcomponent of the cover is the door 102. The door is rectangular in structure. It is slidably disposed within the pair of grooves 100. The door has a handle 104 formed thereon for allowing the door to be slid in one position to prevent access to the first compartment 68. The door can also be slid in another position to allow access to the first compartment 68.

The third major component is the hinge means 106. The hinge means allow the cover to be disposed over the base between the top and bottom walls 22, 24 thereof. In this configuration, access to the interior of the base and interior of the cover is prevented. The cover and base are thereby placed in a closed orientation. The hinge means also allows access to the interior of the base and interior of the cover. By allowing this access, an opened orientation is defined.

The fourth major component is the magnet 108. The magnet is elongated and rigid in structure. It is embedded in the outer side wall of the base.

The fifth major component is the metal insert 110. It is embedded in the outer side wall 60 of the cover. The metal insert is adapted to be coupled to the magnet 108 in a closed orientation. When the metal insert is coupled to the magnet, the cover is locked to the base.

The sixth major component is the clip 112. The clip is coupled to the outer surface of the backing plate of the base. The clip has a loop formed thereon. The loop is adapted to be secured to the belt or clothing of a user for easy access. The clip also allows the present invention to be conveniently transported from one location to another.

The present invention is constructed of a durable and aesthetically pleasing material such as hardwood. Surface ornamentation in the form of inlay work may be disposed on the cover to enhance its appearance. The present invention is sized with a dimension that enables it to be carried by a user on a belt. In the preferred embodiment, the dart holder of the present invention holds up to six darts. The compartments hold all accessories and parts pertaining to the six darts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A dart carrier for holding and transporting darts and accessories comprising, in combination:

a base comprising:

an essentially rectangular backing plate having an inner surface and an outer surface, and a periphery extending outwardly from the backing plate and thus creating a hollow interior adjacent to the interior surface thereof and with the periphery formed of opposed inner and outer side walls with a top wall and a bottom wall extended therebetween;

a first wall disposed within the interior of the base and extended between the inner and outer side walls thereof to define a first compartment located between the first wall and the bottom wall;

a second wall disposed within the interior of the base and extended between the top wall and first wall to define a second compartment located adjacent to the inner side wall and a third compartment located adjacent to the outer side wall;

a drawer slidably disposed within the first compartment of the base for holding dart accessories;

a plurality of angular pockets disposed within the second compartment of the base and with each used for holding dart accessories; and a block-shaped dart holder disposed upon the first wall in the third compartment of the base and with the dart holder having plurality of recesses formed therein with each recess adapted to hold a dart;

a cover comprising:

an essentially rectangular backing plate having an inner surface and an outer surface and a periphery extending outwardly from the backing plate and thus creating a hollow interior adjacent to the interior surface thereof and with the periphery formed of opposed inner and outer side walls with a top wall and a bottom wall extended therebetween;

a first wall disposed within the interior of the cover and extended between the top and bottom walls thereof to define a first compartment located adjacent to the outer side wall;

a second wall disposed within the interior of the cover and extended between the inner side wall and first wall thereof to define a second compartment located above the second wall and a third compartment located below the second wall;

a plurality angular pockets disposed within the first compartment of the cover and with each adapted for holding dart accessories;

a plurality of angular pockets disposed within the second compartment of the cover for holding dart accessories;

a block-shaped tip holder slidably disposed in the third compartment of the cover and with the tip holder having plurality of recesses formed therein for holding dart tips; and a door slidably disposed over the first compartment;

hinge means pivotally coupled between the inner side wall of the base and inner side wall of the cover;

fastening means for securing the cover to the base and thereby preventing access to the interiors of the cover and base; and a clip coupled to the outer surface of the backing plate of the base with the clip having a loop formed thereon adapted to be secured to the belt of a user.

2. A dart carrier for holding and transporting darts and accessories comprising, in combination:

a base comprising:

a backing with a sidewall peripherally extended from the backing to define a hollow interior;

a plurality of compartments formed within the interior of the base;

a drawer slidably disposed in one of the compartments of the base for holding dart accessories therein;

a plurality of pockets disposed in at least one of the compartments of the base for holding dart accessories therein; and a dart holder disposed in one of the compartments of the base for holding darts;

a cover comprising:

a backing with a sidewall peripherally extended from the backing to define a hollow interior;

a plurality of compartments formed within the interior of the cover;

a plurality of pockets disposed in at least one of the compartments of the cover for holding dart accessories therein; and a tip holder disposed in one of the compartments of the cover for holding dart tips; and hinge means for pivotally coupling the cover to the base; and a clip coupled to the base remote from the interior thereof with the clip adapted to be secured to the belt of a user.

* * * * *